United States Patent [19]

Sutrina

[11] Patent Number: 4,658,589

[45] Date of Patent: Apr. 21, 1987

[54] NON-CONDENSIBLE EJECTION SYSTEM FOR CLOSED CYCLE RANKINE APPARATUS

[75] Inventor: Thomas A. Sutrina, Rockford, Ill.

[73] Assignee: Sundstrand Corporation, Rockford, Ill.

[21] Appl. No.: 842,163

[22] Filed: Mar. 21, 1986

[51] Int. Cl.[4] ..... F01K 15/04

[52] U.S. Cl. ..... 60/646; 60/657; 60/692

[58] Field of Search ..... 60/646, 657, 692

[56] References Cited

U.S. PATENT DOCUMENTS 1,688,761 12/1921 Sperry .
3,109,401 8/1959 Karig .
3,151,461 5/1962 Sebald et al. .
3,243,961 11/1962 Caracristi .
3,327,669 6/1965 Olson .
3,838,658 10/1974 Faeth .
3,964,416 6/1976 Kiraly et al. .

*Primary Examiner*—Allen M. Ostrager
*Attorney, Agent, or Firm*—Wood, Dalton, Phillips, Mason & Rowe

[57] ABSTRACT

An ejection system including a steam ejector 48 having a steam nozzle 54 aligned with a diffuser 56 which defines a outlet from the ejection system. The ejector has an inlet 46, 52 to the interface of the nozzle 54 and the diffuser 56. A normally closed, non-condensible flow control valve 24 has an outlet 36 connected to the ejector inlet 46 and an inlet 32 adapted to be connected to a working fluid flow path 30 of a Rankine cycle apparatus. A motor 40, 42 is provided for selectively operating the flow control valve 24. A steam generating reaction chamber 60 is in fluid communication with the steam nozzle 54 and first and second pressure vessels 62, 64 are provided and adapted to contain a different reactant of a multi-reactant steam producing chemical reaction. A valve 66 controls fluid communication between the pressure vessels 62, 64 and the reaction chamber 60.

11 Claims, 2 Drawing Figures

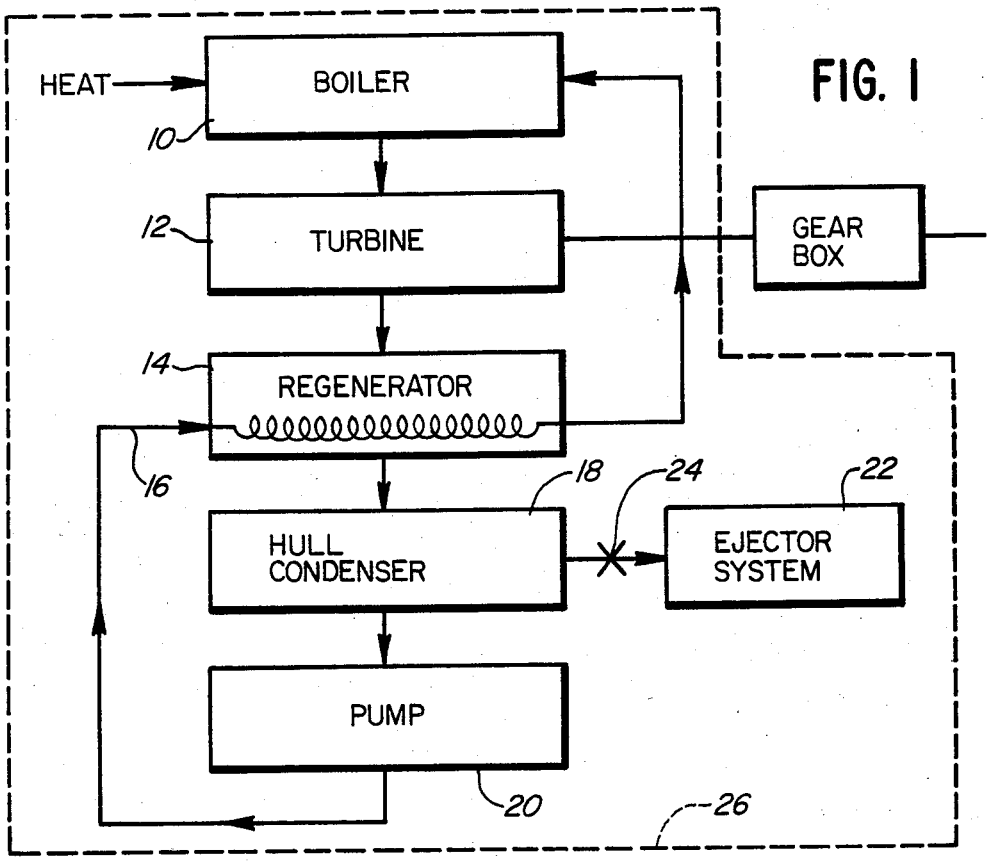
FIG. 1
FIG. 2
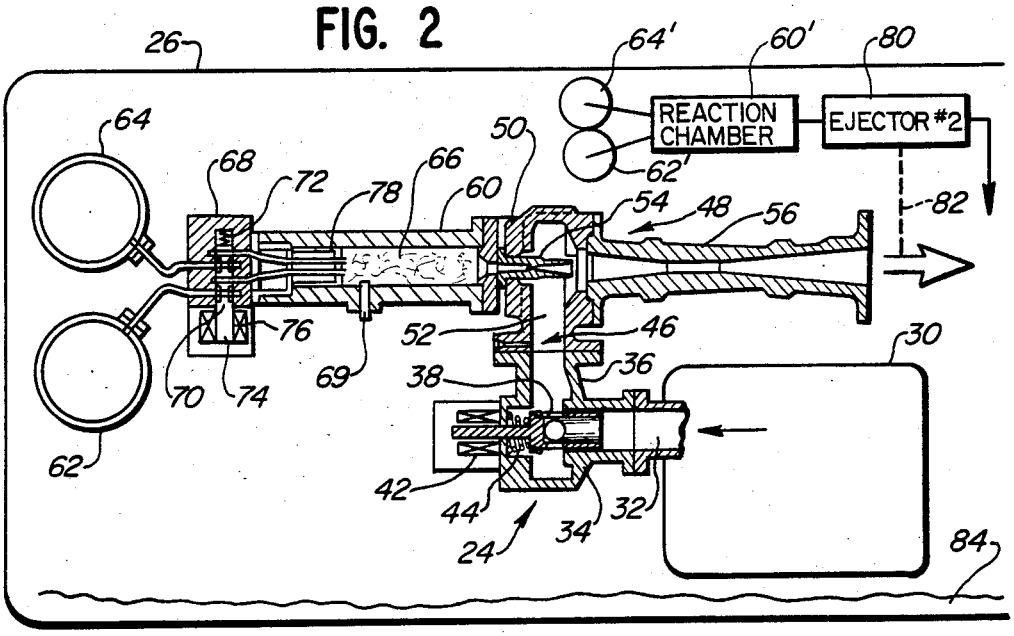

NON-CONDENSIBLE EJECTION SYSTEM FOR CLOSED CYCLE RANKINE APPARATUS

Field of the Invention

This invention relates to an ejector system for ejecting non-condensible gases (non-condensibles) from a closed cycle Rankine apparatus, and more specifically, to such an ejection system which is provided with its own source of pressurized fluid to operate independent of the working fluid in the Rankine apparatus.

Background of the Invention

Over the years, a variety of stored chemical energy, motion producing systems have been proposed. Frequently, but not always, such systems have been intended for use in providing the propulsion for a naval torpedo.

In the usual case, chemical reactants are combined to generate heat which in turn is utilized to generate steam to power a turbine or the like.

Initially, such systems employed open cycle Rankine apparatus including a turbine and which essentially required that spent steam be dumped overboard. When used in a torpedo, a number of disadvantages resulted. For one, the torpedo was relatively noisy as the spent steam was discharged. Secondly, in some instances, the gaseous material being dumped would leave a visible trail highlighting the path that the torpedo was taking.

Thirdly, because the spent steam had to be dumped underwater, the pressure against which the steam was being dumped would vary depending upon the running depth of the torpedo. Thus, turbine efficiency was sensitive to the depth of operation.

In order to avoid these and other difficulties, closed Rankine cycle systems or the placing of the power plant in a pressure hull were proposed. Such systems, rather than dumping spent steam from the turbine, condensed the same and recirculated it to the boiler for re-use or contained it within the pressure hull. As a consequence, noise associated with steam discharge was eliminated. Similarly, gaseous trails were likewise eliminated and depth sensitivity completely avoided.

However, in reverting to closed Rankine cycle apparatus, a new difficulty is encountered. It is the inefficiency in operation of Rankine cycle apparatus associated with the presence of non-condensibles, typically air, in the working fluid flow path of the apparatus. In particular, at the operating temperatures of such apparatus, the much lesser sensible heat of non-condensible gases such as air as compared to steam substantially lowers efficiency.

Where stored energy systems are being utilized in torpedos and employ closed cycle Rankine power plants, evacuation of the system is not practical since the torpedo may be stored for a considerable period prior to use. Other methods of ridding the system of non-condensibles as may be employed with conventional boiler systems are not satisfactory.

Torpedos optimally require operation at full power immediately at start-up. Thus, to avoid the inefficiencies associated with the presence of non-condensibles that would prevent utilization of full power at start-up, the non-condensibles must be removed extremely rapidly as part of the start-up sequence.

The present invention is directed to overcoming the previously mentioned difficulties.

Summary of the Invention

It is the principal object of the invention to provide a new and improved closed Rankine cycle power plant. More specifically, it is an object of the invention to provide such a power plant with a means for removing non-condensibles immediately upon start-up. It is also an object of the invention to provide an ejector system that is ideally suited for use with closed Rankine cycle power plants.

An exemplary embodiment of the invention constitutes an apparatus for ejecting non-condensible gases from a closed Rankine cycle motion producing system including a boiler, an engine, a condenser and a means for circulating a condensible working fluid in a closed path through the boiler, engine and condenser. The apparatus comprises a valve having an inlet connected to the closed path, an outlet and a valve element controlling the flow of fluid between the inlet and the outlet.

A fluid ejector including a power fluid inlet, an ejection fluid inlet and an outlet is provided and is operative, upon flowing a pressurized power fluid from the power fluid inlet to the outlet, to create a reduced pressure at the ejection fluid inlet which in turn is connected to the valve outlet. A reaction chamber is connected to the power fluid inlet and is adapted to contain an exothermic chemical reaction which provides the pressurized power fluid as a product. At least one reactant chamber for containing a reactant for the exothermic chemical reaction is connected to the reaction chamber and means are provided for controlling the flow of the reactant from the reactant chamber to the reaction chamber.

As a consequence of this construction, upon start-up of the system, the exothermic chemical reaction may be initiated to immediately produce a pressurized power fluid for operating the ejector which in turn will apply a reduced pressure to the flow path of the Rankine cycle apparatus. This in turn will result in non-condensibles occupying such flow path being withdrawn through the ejector to be discharged exteriorally of the flow path.

In a preferred embodiment, there are two of the reactant chambers, each housing at different reactant for the exothermic chemical reaction. The controlling means simultaneously controls the flow from both of the reactant chambers.

In a preferred embodiment, the invention contemplates the controlling means to comprise a single spool valve.

In one embodiment of the invention, the power fluid inlet for the ejector comprises a nozzle in alignment with a converging/diverging diffuser which constitutes the ejector outlet. The ejection fluid inlet surrounds the interface of the nozzle and the diffuser.

In a highly preferred embodiment, a heat sink is interposed between the controlling means and the reactant chamber and constitutes part of the flow path from the reactant chamber to the reaction chamber. The heat sink permits expansion of the reactant as it flows through the heat sink to absorb heat from the heat sink to thereby thermally isolate the reactant and reaction chambers.

In a highly preferred embodiment, the ejector constitutes a steam ejector and the reactants utilized in the reaction generate steam as a reaction product. Preferrably, the reactant chambers are storage vessels which in turn are pressure vessels.

In one embodiment of the invention, the reaction chamber may contain a catalyst for promoting the chemical reaction.

Other objects and advantages will become apparent from the following specification taken in connection with the accompanying drawings.

Description of the Drawings

FIG. 1 is a block diagram of a closed Rankine cycle power plant embodying an ejector system made according to the invention; and FIG. 2 is a sectional view of the ejector system.

Description of the Preferred Embodiment

A typical Rankine cycle power plant with which the invention may find use is illustrated in FIG. 1 and is seen to include a boiler 10 in which a working fluid such as water may be vaporized. To accomplish the vaporization, heat is added to the boiler as illustrated by the legend appearing in FIG. 1. In the usual case, the heat will be generated by an exothermic chemical reaction.

Vaporized working fluid from the boiler is fed to an engine in the form of a turbine 12 which converts the energy from the steam into motion. When the system is utilized for propelling a torpedo, the turbine 12, through some suitable form of transmission, drives propellers.

Spent steam from the turbine 12 may be fed to a regenerator 14. The regenerator 14 removes any superheat left in the steam by cooling it with make-up water fed through a flow path 16 extending to the boiler 10.

Saturated steam leaves the regenerator 14 and is passed to a so-called hull condenser 18 whereat the steam is condensed to water. The condensed water may be pumped by a pump 20 through the flow path 16 extending through the regenerator 14 and back to the boiler 10 to serve as make-up water thereat.

According to the invention, the system also includes an ejector system 22. The ejector system is connected via a valve 24 to any suitable point in the closed path for the working fluid. Generally speaking, the connection will be to the highest point in the closed flow path and frequently this may be intentionally located near the outlet end of the hull condenser 18.

In any event, when the valve 24 is opened and the ejector 22 operated, a reduced pressure will be applied to the interior of the closed flow path of the apparatus thereby withdrawing non-condensible gases therein. Such non-condensible gases are ejected by the ejector system 22 to a location externally of the closed flow path containing the system working fluid. Where the apparatus is being utilized as a propulsion source for a torpedo, the ejection will typically be to some portion of the torpedo hull that is capable of withstanding a certain degree of pressure and such portion is shown schematically at 26. Often these hull sections will also house the complete power plant which is not constructed to withstand depth pressure. Pressure resistance is desirable in that the non-condensible gases and, as will be seen, the fluid utilized to operate the ejector system 22 remain contained within the hull of the torpedo as opposed to being discharged overboard which could be at a substantially greater pressure than the hull section, thus affecting the ejection.

The ejector system 22 and associated components are illustrated in greater detail in FIG. 2. The point of connection to the closed flow path of the Rankine cycle power plant is shown somewhat schematically at 30 within the hull of pressure section 26 of the torpedo which is also shown schematically in FIG. 2.

The valve 24 includes an inlet 32 in fluid communication with the closed flow path 30. The valve 24 includes a housing 34 as well as an outlet 36. A spool valve 38 is reciprocally mounted within the housing 34 and is movable between positions wherein fluid communication between the inlet 32 and 36 is permitted (as shown in FIG. 2) and a position wherein such fluid communication is precluded. To move the valve to the position illustrated in FIG. 2, the spool 38 includes an armature 40 movable within a solenoid coil 42. A biasing spring 44 normally acts against the spool 38 to urge the same to a closed position. Thus, the valve 24 will be closed except when the solenoid 42 is energized electrically.

The outlet 36 of the valve 24 is connected to a non-condensible inlet 46 of a conventional steam ejector, generally designated 48. The ejector 48 includes a housing 50 containing a suction chamber 52 in fluid communication with the non-condensible inlet 46. The suction chamber surrounds the interface of a steam nozzle 54 which is aligned with but axially spaced from a converging/diverging diffuser 56 which serves as the ejector outlet.

As is well known, flowing a pressurized power fluid such as steam under pressure through the nozzle 54 will result in a reduction in pressure within the suction chamber 52. Consequently, when such occurs and the valve 24 is opened, an evacuating force will be applied to the interior of the closed Rankine cycle working fluid flow path 30.

The nozzle 54 is in fluid communication with the interior of a reaction chamber 60. The reaction chamber 60 houses or contains the reactants in a exothermic chemical reaction which generates a pressurized fluid. In the usual case, the fluid will be steam but in some instances, other materials could be utilized. Reactants for the reaction may be housed in one or more pressure vessels 62, 64. For example, the pressure vessels 62 and 64 may respectively contain pressurized oxygen and hydrogen which are combined to produce water within the reaction chamber 60. If desired, any suitable catalyst 66 capable of promoting the reaction may be contained within the reation chamber 60.

A valve 68 is interposed between the pressure vessel 62 and 64 on the one hand and the reaction chamber 60 on the other. The valve 68 is normally closed but may be opened upon start-up of the propulsion system simultaneously with or just prior to the opening of the valve 24. When the valve 68 is opened, the reactants from the pressure vessel 62 and 64 are admitted to the reaction chamber 60 whereat they combine to produce steam which in turn exits the reaction chamber 60 through the nozzle 54. An ignition source 69 may be needed to start the reaction. This provides the evacuating force for the Rankine cycle system as mentioned previously.

In a preferred embodiment, the valve 68 is a spool valve having a spool 70 normally urged by a biasing spring 72 to a closed position. As shown in FIG. 2, the spool 70 is in an open position. The spool 70 includes an end 74 which acts as an armature within a solenoid coil 76 which, when energized, moves the spool 70 to the open position illustrated.

Downstream of the valve 68 and on the upstream end of the reaction chamber 60 is a heat sink element 78 which is configured to allow the reactants to expand as they enter the reaction chamber 60. In the usual case, the reactants will be maintained within the pressure vessel 62 and 64 in a wholly or partially liquid state and as a result of the expansion occurring in the heat sink 78, they will change phase to the gaseous state. Such a phase change will, of course, absorb heat at the heat sink 78, which will be heated by the reaction occurring in the chamber 60. Such absorption of heat provides for thermalisolation between the reactant storage chambers, that is, the vessels 62 and 64 on the one hand and the reaction chamber 60 on the other.

In the usual case, upon start-up of the system, the valve 70 will be immediately opened. The pressure of the reactants in the vessels 62 and 64 will expel the reactants through the valve 68 into the reaction chamber 60 whereat the exothermic chemical reaction necessary to generate steam for operating the ejector 48 will immediately occur. Substantially simultaneously therewith, the valve 24 will be opened. Generally speaking, the valve 24 will be opened slightly after initiation of the reaction within the chamber 60 so as to allow sufficient steam pressure to build up to assure that a reduced pressure will be applied to the interior of the system 30. When the valve 24 opens, the system 30 will be immediately evacuated through operation of the ejector 48.

In some instances, it may be desirable to utilize a multiple stage ejector. In such a case, the diffuser 56 may be connected the inlet of a second, like ejector 80 as indicated by the dotted line flow path 82 in FIG. 2. The ejector 80 may be powered by a source of steam identical to that shown in connection with the ejector 48 and illustrated by primed reference numbers.

Whether one or two ejectors are used, the diffuser 56 acts as the outlet 40 either and the same is to discharge into a section of the hull capable of withstanding the pressure. In actuality, very little pressure will be present since the product of the reaction occurring in the reaction chamber 60 is steam and the same will readily condense on the cold hull and exteriorally of the closed system 30 as illustrated by the level of condensate 84 illustrated in FIG. 2.

Of course, the non-condensibles removed from the closed flow path will remain within the hull. Depth pressure will remain outside the hull. Consequently, full power is almost immediately available upon start-up of the system.

What us ckaimed is:

1. Apparatus for ejecting non-condensible gases from a closed Rankine cycle motion producing system including a boiler, an engine, a condenser and means for circulating a condensible working fluid in a closed path through said boiler, engine and condenser, said apparatus comprising:

a valve having an inlet connected to said closed path, an outlet and a valve element controlling the flow of fluid between said inlet and said outlet;

a fluid ejector including a power fluid inlet, an ejection fluid inlet and an outlet and being operative upon flowing a pressurized power fluid from said power fluid inlet to said outlet, to create a reduced pressure at said ejection fluid inlet, said ejection fluid inlet being connected to said valve outlet;

a reaction chamber connected to said power fluid inlet and adapted to contain an exothermic chemical reaction which provides a pressured power fluid as a product;

at least one reactant chamber for containing a reactant for said exothermic chemical reaction and connected to said reaction chamber;

means for controlling the flow of said reactant from said reactant chamber to said reaction chamber.

2. The apparatus of claim 1 wherein there are two said reactant chambers, each housing a different reactant for said exothermic chemical reaction, and said controlling means simultaneously controls the flow from both said reactant chambers.

3. The apparatus of claim 2 wherein said controlling means is a spool valve.

4. The apparatus of claim 1 wherein said power fluid inlet comprises a nozzle in alignment with a converging/diverging diffuser constituting said ejector outlet, said ejector fluid inlet surrounding the interface of said nozzle and said diffuser.

5. The apparatus of claim 1 further including a heat sink interposed between said controlling means and said reaction chamber and constituting part of the flow path from said reactant chamber(s) to said reaction chamber; said heat sink permitting expansion of said reactant as it flows through the heat sink to absorb heat from said heat sink to thereby thermally isolate said reactant and reaction chambers.

6. Apparatus for ejecting non-condensible gases from a closed Rankine cycle motion producing system including a boiler, an engine, a condenser and means for circulating a condensible working fluid in a closed path through said boiler, engine and condenser, said apparatus comprising:

a steam ejector having a non-condensibles inlet connected to said closed path, and outlet isolated from said closed path and a steam inlet;

a steam generating reaction chamber connected to said steam inlet; and at least one steam producing reactant storage container selectively connectable to said reaction chamber.

7. The apparatus of claim 6 further including flow control means interposed between aid closed path and said non-condensibles inlet.

8. The apparatus of claim 6 wherein said storage container is a pressure vessel.

9. An ejector system for use with a closed Rankine cycle apparatus comprising:

a steam ejector having a steam nozzle aligned with a diffuser, said diffuser defining an outlet from said ejector system, and an inlet to the interface of said nozzle and said diffuser;

a normally closed, non-condensibles flow control valve having an outlet connected to said ejector inlet and an inlet adapted to be connected to the working fluid flow path of a Rankine cycle apparatus;

a motor for selectively operating said flow control valve;

a steam generating reaction chamber in fluid communication with said steam nozzle;

first and second pressure vessels, each adapted to contain a different reactant of a multi-reactant, steam producing, chemical reaction;

valve means for controlling fluid communication between said pressure vessels and said reaction chamber.

10. The ejector system of claim 9 wherein said reaction chamber contains a catalyst for promoting said chemical reaction.

11. The ejector system of claim 9 wherein said valve means comprises a single spool valve.

* * * * *